US006408758B1

(12) United States Patent
Duguet

(10) Patent No.: US 6,408,758 B1
(45) Date of Patent: Jun. 25, 2002

(54) PHOTOETCHED-FILAMENT PYROTECHNIC INITIATOR PROTECTED AGAINST ELECTROSTATIC DISCHARGES

(75) Inventor: Jean-René Duguet, Survilliers (FR)

(73) Assignee: Livbag SNC, Rue Lavoisier (FR)

( * ) Notice: Subject to any disclaimer, the term of this patent is extended or adjusted under 35 U.S.C. 154(b) by 0 days.

(21) Appl. No.: 09/695,275

(22) Filed: Oct. 25, 2000

(30) Foreign Application Priority Data

Nov. 5, 1999 (FR) ..... 99 13849

(51) Int. Cl.[7] ..... F42C 19/08

(52) U.S. Cl. ..... 102/202.2; 102/202.5; 102/202.7; 102/202.14

(58) Field of Search ..... 102/202.7, 202.4, 102/202.5, 202.2, 275.5, 202.14; 361/247

(56) References Cited

U.S. PATENT DOCUMENTS

| | | | | |
|---|---|---|---|---|
| 3,753,403 | A | | 8/1973 | Menichelli |
| 3,974,424 | A | * | 8/1976 | Lee |
| 4,517,895 | A | | 5/1985 | Rucker |
| 4,729,315 | A | * | 3/1988 | Proffit et al. |
| 4,959,011 | A | | 9/1990 | Nilsson |
| 4,976,200 | A | * | 12/1990 | Benson |
| 5,140,906 | A | * | 8/1992 | Little |
| 5,230,287 | A | * | 7/1993 | Arrell, Jr. et al. |
| 5,309,841 | A | * | 5/1994 | Hartman et al. |
| 5,345,872 | A | * | 9/1994 | Takahashi et al. |
| 5,544,585 | A | * | 8/1996 | Duguet |
| 5,576,509 | A | * | 11/1996 | Refouvelet et al. |
| 5,596,163 | A | * | 1/1997 | Caflisch et al. |
| 5,699,032 | A | * | 12/1997 | Ulm, Jr. et al. |
| 5,736,668 | A | * | 4/1998 | Fogle, Jr. et al. |
| 5,798,476 | A | * | 8/1998 | Bailey |
| 5,847,309 | A | * | 12/1998 | Baginski |
| 5,905,226 | A | * | 5/1999 | Baginski |
| 5,932,832 | A | * | 8/1999 | Hansen et al. |
| 6,166,452 | A | * | 12/2000 | Adams et al. |
| 6,192,802 | B1 | * | 2/2001 | Baginski |
| 6,269,745 | B1 | * | 8/2001 | Cieplik et al. |
| 6,272,965 | B1 | * | 8/2001 | Baginski et al. |
| 6,272,992 | B1 | * | 8/2001 | Chatley, Jr. |
| 6,324,979 | B1 | * | 12/2001 | Troianello |

FOREIGN PATENT DOCUMENTS

| | | |
|---|---|---|
| EP | 0 802 092 A1 | 4/1997 |
| WO | WO 98/25100 | 6/1998 |

OTHER PUBLICATIONS

PCT Application WO 9825100, 6–98, Bos et al.*

* cited by examiner

*Primary Examiner*—Michael J. Carone
*Assistant Examiner*—Troy Chambers
(74) *Attorney, Agent, or Firm*—Oliff & Berridge, PLC

(57) ABSTRACT

The present invention relates to the field of electropyrotechnic initiators comprising a thick-film multifoil circuit.

The electrical circuit is photoetched on an insulating support (16). It consists of a resistive first foil having a central part (17) of constant width. This first foil is covered, except on the central part (17), by two conducting areas (28, 29) made of copper. The circuit (18) has an outline consisting of curved lines whose radius is greater than $7\times10^{-4}$ m and whose shortest distance from the edge of the support (16) is at least $35\times10^{-5}$ m.

Such an initiator has an enhanced electrostatic discharge resistance.

7 Claims, 3 Drawing Sheets

PHOTOETCHED-FILAMENT PYROTECHNIC INITIATOR PROTECTED AGAINST ELECTROSTATIC DISCHARGES

The present invention relates to the field of electropyrotechnic initiators intended to ignite the pyrotechnic charges of the gas generators that have to be activated in motor-vehicle airbags. More specifically, the invention relates to an initiator whose initiation head comprises a thick-film metal multifoil circuit which is well protected against electrostatic discharges.

Conventionally, electropyrotechnic initiators intended for motor-vehicle safety consist of an insulating body extended by a fragmentable metal cap and penetrated by two electrodes. The electrodes are connected together via a resistive heating filament surrounded by an explosive initiating composition, for example a composition based on lead triresorcinate. However, such initiators, which are described for example in United States Patents U.S. Pat. No. 4,517,895 or U.S. Pat. No. 4,959,011, have the drawback of being sensitive to the vibrations of the motor vehicle at the soldered joints between the resistive filament and the electrodes. When these soldered joints are repeatedly stressed by the vibrations of the vehicle, they can break and make the igniter inoperable.

To remedy this drawback, initiators have therefore been developed in which the electrodes are in contact with two separate conducting metal areas lying on the surface of the insulating body which is inside the metal cap. These two areas are connected together via a narrow resistive flat strip deposited on the surface of the insulating body. The conducting areas and the resistive strip are covered with an explosive initiating composition.

These initiators fall into two large families. Firstly, initiators whose conducting areas consist of printed circuits, like those described in European Patent EP 0,802,092 for example, and, secondly, initiators in which the conducting areas and the resistive strip consist of a stack of photoetched metal foils, like those described, for example, in U.S. Pat. No. 5,544,585. Initiators corresponding to the latter family are often called "thick-film multifoil initiators", the thickness of each metal foil being generally between $2\times10^{-6}$ m and $7\times10^{-6}$ m, that is between 2 and 7 micrometres.

Initiators whose conducting areas consist of printed circuits allow electronic components such as varistors or capacitors which provide the initiator with a very high level of electrostatic protection, to be easily soldered using surface mount technology.

On the other hand, with thick-film multifoil initiators which are, however, simple and inexpensive, this soldering is not so easy and these initiators were, hitherto, less well protected against electrostatic discharges.

The object of the present invention is specifically to provide thick-film multifoil initiators which are well protected against electrostatic discharges while requiring no soldering of electronic components during assembly.

The invention therefore relates to an electropyrotechnic initiator, comprising, inside a fragmentable container closed and supported by an overmoulding, an initiation head consisting of an impermeable wall formed by a solid body of height h which has a plane upper face and which grips, over its entire height h, a glassy structure penetrated by two electrodes in the form of pins, the said electrodes each having one end which protrudes from the said plane upper face, this protrusion allowing them to be electrically connected to an electrical thick-film multifoil circuit supported by an insulating support which rests on the said plane upper face and is itself penetrated by the said electrodes, the said circuit having a flat resistive heating element connected to the said electrodes via two separate conducting metal areas lying on the said support, each area being in contact with one of the two electrodes, the said flat element and the said metal areas being covered with a pyrotechnic initiating composition, the said initiator being characterized in that:

the said thick-film multifoil circuit comprises a first film consisting of a first foil made of a resistive metal alloy, having a thickness of between $2\times10^{-6}$ m and $7\times10^{-6}$ m, adhesively bonded to the said support and penetrated by the said electrodes, the said first foil having a shape which has, between the electrodes, a central part forming the flat resistive element and the external outline of which first foil, except for the said central part, consists of curved lines whose radii of curvature are greater than $7\times10^{-4}$ m, the said first foil being covered, except for the said central part, with a second, conducting, metal film serving to form the metal areas which are penetrated by the said electrodes and which have a shape and thickness which are similar to those of the parts of the first foil that they cover.

According to a first preferred variant of the invention, the shortest distance between the edge of the insulating support and the external outline of the thick-film multifoil circuit is at least $35\times10^{-5}$ m.

According to a second preferred variant of the invention, the said central part has a constant width.

The initiators according to the invention are very simple and robust, they include no additional component fixed by soldering and are easy to manufacture when the thick-film multifoil circuit is produced by photoetching, as described, for example, in Patent U.S. Pat. No. 5,544,585. It has been found that these initiators exhibit remarkable resistance to electrostatic discharges, particularly when the shape of the thick-film multifoil circuit is such that the plane joining the two electrodes passes, level with the support, through an alternation of conducting zones and insulating zones, as will be described in detail later in the description.

The first foil will advantageously consist of a resistive alloy based on nickel and chromium whereas the second film will advantageously consist of a copper foil.

The second foil may advantageously be covered with a third film which will be a coating of tin-based tinning similar in shape and thickness to the parts of the second film that it will cover.

Finally, the overall shape of the electrical thick-film multifoil circuit will advantageously be that of an "S".

The initiators according to the invention can thus easily be mass-produced at modest cost and their preferred application is in pyrotechnic gas generators intended to activate airbags in a motor vehicle.

A detailed description of a preferred embodiment of the invention will now be given with reference to FIGS. 1 to 5.

Figure 1:
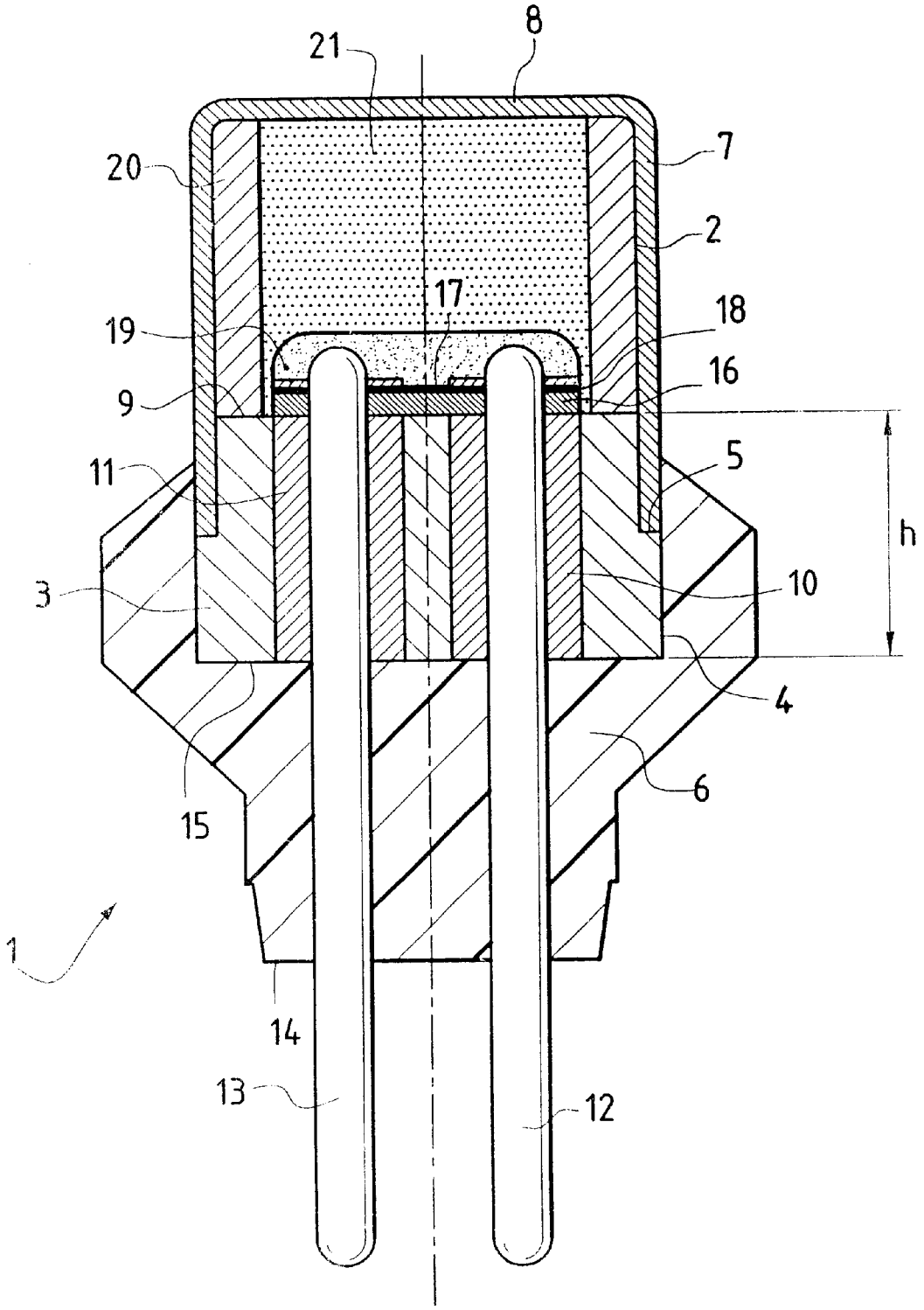
FIG. 1 is an axial sectional view of an initiator according to the invention, the circuit of which comprises two films.

An electropyrotechnic initiator 1 according to the invention is shown in FIG. 1. This initiator 1 consists of fragmentable cylindrical container 2 open at one of its ends. A solid cylindrical body 3 closes the open end of the container 2. The side wall 4 of the body 3 has an external shoulder 5 on which the open end of the container 2 bears. The container 2 and the body 3 are gripped in an overmoulding 6 which holds them together. The container 2 thus has the shape of a cylindrical cap having a side wall 7 and a solid closed end 8. Advantageously, the container 2 consists of a thin light metal such as aluminium and its plane face is advantageously weakened in order to be able to easily open under the effect of an increase in the pressure within the container. The overmoulding 6 is preferably made in a thermoplastic resin such as, for example, polyethylene terephthalate.

The body 3 must be able to function as a wall impermeable to a detonation and to the combustion gases resulting from this detonation. This body 3 is preferably made in a dense metal such as steel. The body 3 has a plane upper face 9 and a lower, also plane, face 15 and it grips, over its entire height h, two hollow glass tubes 10 and 11. Each of these tubes contains an electrode 12, 13 in the form of a pin.

Each electrode has one end which protrudes from the plane upper face 9 of the body 3 and an end which protrudes from the lower face 14 of the overmoulding 6. Fixed to the plane upper face 9 of the body 3, for example by adhesive bonding, is an insulting support 16 consisting of a plate made from a glass/resin compound, the resin of which may, for example, be a polyepoxy resin. The electrodes 12 and 13 penetrate and protrude from the insulating support 16.

The insulating support 16 carries an electrical thick-film multifoil circuit 18 comprising a flat resistive heating element 17. This circuit, which will be described in detail a little later, is penetrated by the electrodes 12 and 13 and electrically connected to them. The circuit 18 comprising the resistive element 17 is covered with a pyrotechnic initiating composition 19, for example one based on lead trinitroresorcinate. The container 2 also contains a metal tube 20 which reinforces the side wall 7. Inside the tube 20 is placed an ignition powder 21 consisting, for example, of a nitrocellulose-based powder or by a mixture of potassium nitrate and boron.

Figure 2:
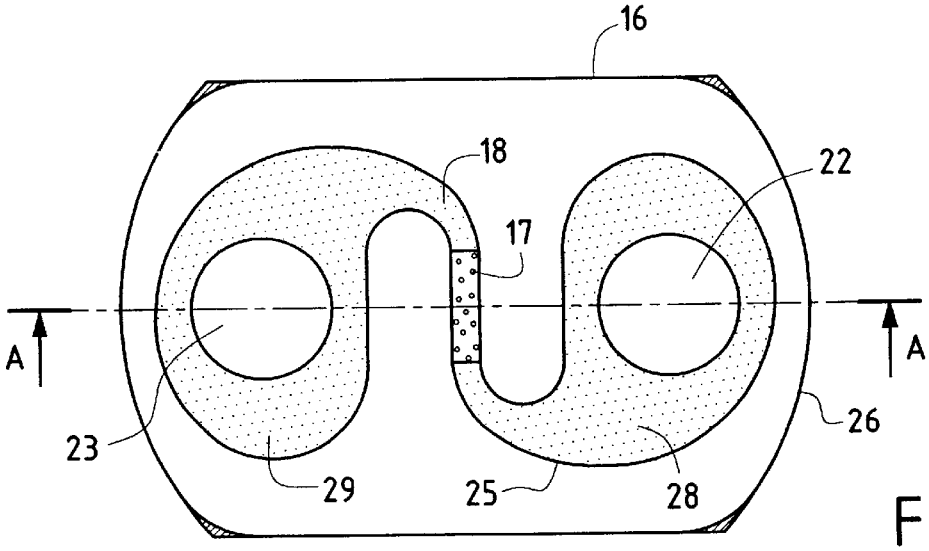
FIG. 2 is a top view of the support and of a thick-film multifoil circuit of the initiator shown in FIG. 1.

The circuit 18 will now be described with reference more particularly to FIGS. 2, 3 and 4. The circuit 18 is supported by the insulating support 16 which is in the form of a plate having two cylindrical channels 22 and 23 for the electrodes 12 and 13 to pass through.

The circuit 18 basically consists of a first foil 24 made of a resistive metal alloy, for example an alloy based on nickel and chromium.

This foil, whose thickness is between 2 and 7 microns, that is to say between $2\times10^{-6}$ m and $7\times10^{-6}$ m, does not cover the channels 22 and 23 and possesses a shape which has, between the channels 22 and 23 into which the electrodes 12 and 13 are to pass, a central part of constant width which will form the flat resistive element 17. Except for this central part, the external outline 25 of this foil 24 consists of curved lines whose radii of curvature are greater than 0.7 mm, i.e. $7\times0^{-4}$ m. Moreover, the shortest distance between the edges 26 of the insulating support 16 and the external outline 25 of the foil 24 must be at least 0.35 mm, i.e. $35\times10^{-5}$ m. The first foil 24 is covered, except for the central part forming the flat resistive element 17, with a second, conducting, metal layer 27, for example made of copper. This second layer 27 serves to form two conducting metal areas 28 and 29 which will be penetrated by the electrodes 12 and 13 and which will be electrically connected to the latter. These areas have a shape identical to the shape of those parts of the sheet 24 that they cover. The thickness of the second film 27 is similar to that of the foil 24.

Figure 4:
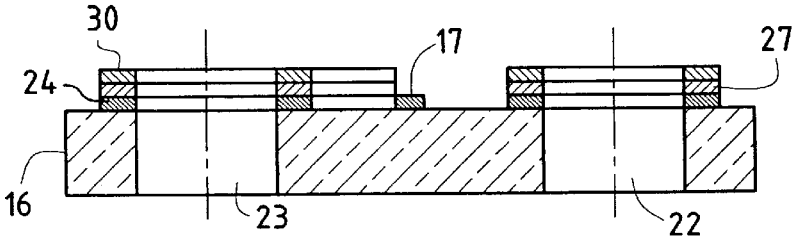
FIG. 4 shows the same section in the case in which the circuit also includes a film of tinning.

As shown in FIG. 4, the second film 27 may advantageously be covered with a third film 30 which will consist of a coating of tinning similar in shape and thickness to the second film 27 and which will therefore leave exposed the flat resistive element 17 belonging to the first foil 24.

Figure 3:
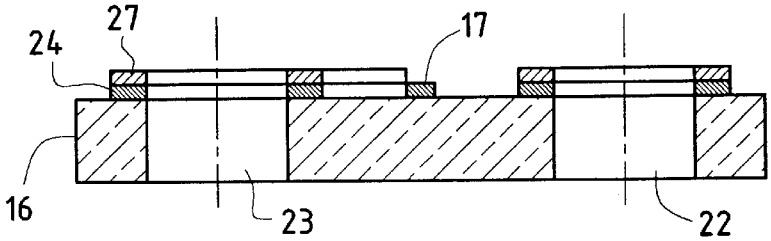
FIG. 3 is a section on A—A of FIG. 2.

At this stage of the description, it should be pointed out that in FIGS. 3 and 4 the thicknesses of the films 24, 27 and 30 are not proportional to the thickness of the insulating support 16.

The deposition onto the support 16 of a thick-film multifoil circuit, in the manner just described, may be easily carried out using the photoetching techniques known to those skilled in the art. It has been found that initiators comprising a circuit 18 according to the invention have an electrostatic discharge resistance greatly superior to that of initiators comprising a conventional thick-film multifoil circuit in which the conducting areas have sharp angles and/or cover the insulating support as far as its periphery. This is particularly true when the overall shape of the circuit 18 is that of an "S", as shown in FIGS. 2, 3 and 4. This shape ensures that, in the plane connecting the two electrodes, level with the support 16, there is an alternation of conducting zones and insulating zones, which greatly enhances the electrostatic discharge resistance of the initiator.

Moreover, it is particularly simple and inexpensive for the initiator according to the invention to be mass-produced. Production starts by depositing the circuit 18 on the insulating support 16 by photoetching. Next, the initiation head is produced by depositing the support thus furnished on the body 3 by inserting and fixing the electrodes 12 and 13. The initiation head is covered with the initiating composition 19 and the head thus covered is inserted into the cap 2, which already contains the reinforcing tube 20 and the ignition powder 21. All that then remains to be done is to close and consolidate the assembly by the overmoulding 6. Moreover, since thick-film multifoil initiators are particularly resistant to vibrations, a preferred application for these initiators is the protection, by pyrotechnic devices, of the occupants of a motor vehicle.

EXAMPLE

Two batches of initiators each having an electrical thick-film multifoil circuit were prepared.

Batch A: conventional circuit according to U.S. Pat. No. 5,544,585

Batch B: circuit according to the invention.

Figure 5:
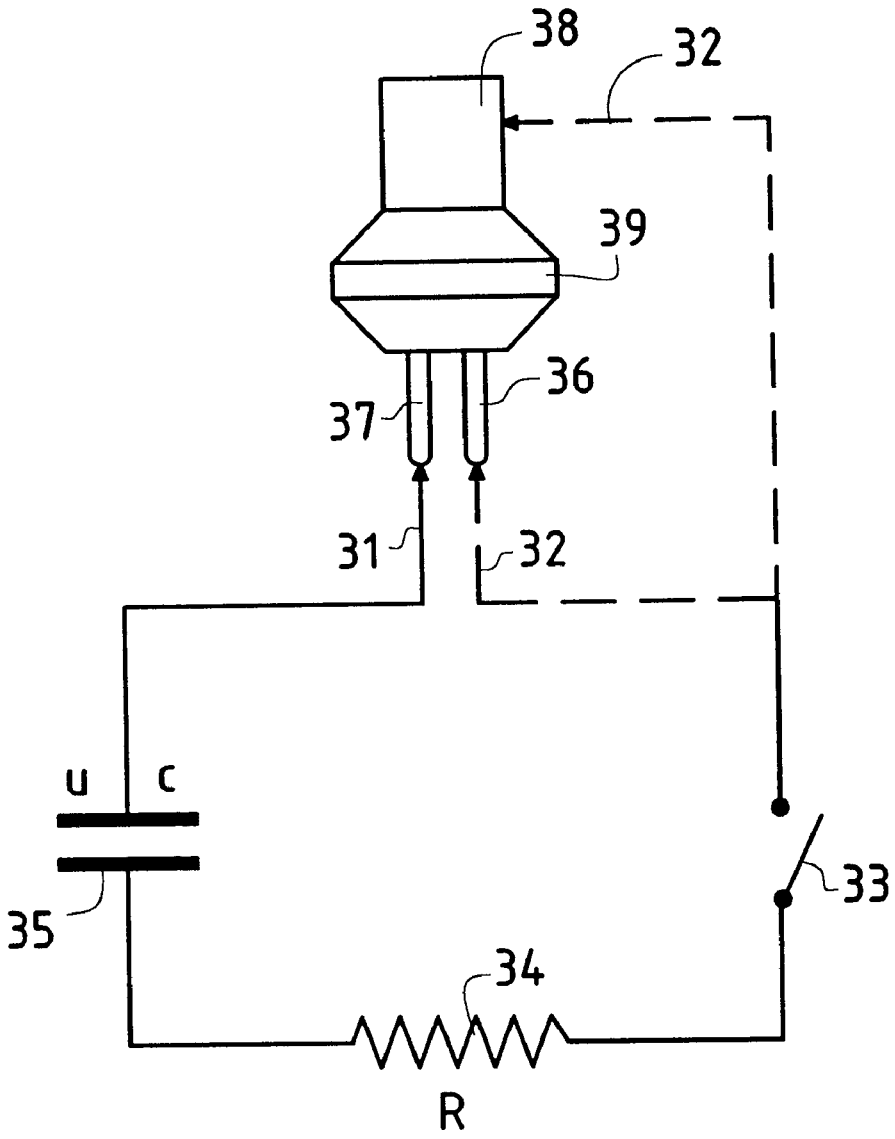
FIG. 5 shows the circuit diagram of a device allowing the electrostatic discharge resistance of the initiators according to the invention to be tested.

The electrostatic discharge resistance of both these batches of initiators was tested in the experimental device shown in FIG. 5.

This device consists of two conducting probes 31 and 32 connected via a switch 33 to a resistor 34 and to a capacitor 35, the switch and capacitor being connected in series. The resistor 34 has a value R and the capacitor 35 has a capacitance C and is charged to a voltage U. The probe 31 is fixed to the electrode 37 of the initiator 39 that it is desired to test, whereas the probe 32 is fixed, as required, to the electrode 36 or to the cap 38 of the initiator 39. It is thus possible to measure, by closing the switch 33, the electrical discharge resistance of the initiator in the configurations in which they are usually tested and which are known by the names "pin to pin" or "pin to case".

The table below gives, for each batch of initiators, the minimum value of the resistance R and of the capacitance C in order not to have any initiator ignition when the capacitor 35 is charged to a voltage of 25,000 volts.

| BATCH | R | C |
|---|---|---|
| A | 5,000 ohms | 500 picofarads |
| B | 330 ohms | 150 picofarads |

What is claimed is:

1. Electropyrotechnic initiator (1) protected against electrostatic discharges, comprising: inside a fragmentable container (2) closed and supported by an overmoulding (6), an initiation head consisting of an impermeable wall formed by a solid body (3) of height h which has a plane upper face (9) and which grips, over its entire height h, a glassy structure (10, 11) penetrated by two electrodes (12, 13) in the form of pins, said electrodes each having one end which protrudes from said plane upper face, this protrusion allowing them to be electrically connected to an electrical thick-film multifoil circuit (18) supported by an insulating support (16) which rests on said plane upper face and is itself penetrated by said electrodes, said circuit having a flat resistive heating element (17) connected to said electrodes via two separate conducting metal areas (28, 29) lying on said support, each area being in contact with one of the two electrodes, said flat element and said metal areas being covered with a pyrotechnic initiating composition (19), characterized in that: said thick-film multifoil circuit (18) has the overall shape of an "S" and comprises a first film consisting of a first foil (24) made of a resistive metal alloy, having a thickness of between $2\times10^{-6}$ m and $7\times10^{-6}$ m, adhesively bonded to said support and penetrated by said electrodes, said first foil having a shape which has, between the electrodes, a central part forming the flat resistive element (17) and the external outline (25) of which first foil, except for said central part, consists of curved lines whose radii of curvature are greater than $7\times10^{-4}$ m, said first foil being covered, except for said central part, with a second, conducting, metal film (27) serving to form the metal areas (28, 29) which are penetrated by said electrodes and which have a shape and thickness which are similar to those of the parts of the first foil that they cover.

2. The initiator according to claim 1, characterized in that the shortest distance between the edge (26) of the support and the external outline (25) of the thick-film multifoil circuit is at least $35\times10^{-5}$ m.

3. The initiator according to claim 2, characterized in that said central part has a constant width.

4. The initiator according to claim 1, characterized in that the plane joining the two electrodes passes, level with the support, through an alteration of conducting zones and insulating zones.

5. The initiator according to claim 4, characterized in that said first foil consists of a nickel-chromium alloy.

6. The initiator according to claim 5, characterized in that said second foil is a copper foil.

7. The initiator according to claim 1, characterized in that the second film is covered with a third film which is a coating of tinning similar in shape and thickness to the second film.

* * * * *